US011586149B2

(12) United States Patent
Gros et al.

(10) Patent No.: US 11,586,149 B2
(45) Date of Patent: Feb. 21, 2023

(54) HOROLOGICAL DISPLAY MECHANISM

(71) Applicant: Montres Breguet S.A., L'Abbaye (CH)

(72) Inventors: Fabien Gros, Clairvaux les Lacs (FR); Alain Zaugg, Le Sentier (CH); Patrice Golay, Le Sentier (CH)

(73) Assignee: Montres Breguet S.A., L'Abbaye (CH)

( * ) Notice: Subject to any disclaimer, the term of this patent is extended or adjusted under 35 U.S.C. 154(b) by 246 days.

(21) Appl. No.: 17/128,687

(22) Filed: Dec. 21, 2020

(65) Prior Publication Data

US 2021/0255585 A1 Aug. 19, 2021

(30) Foreign Application Priority Data

Feb. 19, 2020 (EP) ..... 20158326

(51) Int. Cl.
*G04B 19/02* (2006.01)

(52) U.S. Cl.
CPC ..... *G04B 19/02* (2013.01)

(58) Field of Classification Search
CPC ..... G04B 19/02; G04B 35/00; G04B 19/08; G04B 19/082
See application file for complete search history.

(56) References Cited

U.S. PATENT DOCUMENTS

| | | | | |
|---|---|---|---|---|
| 11,221,589 | B2 * | 1/2022 | Feyer | G04F 7/089 |
| 2014/0293757 | A1 * | 10/2014 | Fracheboud | G04B 19/082 368/132 |
| 2015/0016232 | A1 * | 1/2015 | Graemiger | G04F 7/0871 368/132 |
| 2018/0341224 | A1 * | 11/2018 | Alagon Carrillo | G04B 13/005 |
| 2019/0086867 | A1 * | 3/2019 | Gerber | G04B 19/202 |
| 2020/0117142 | A1 * | 4/2020 | Denden | G04B 19/04 |
| 2021/0173344 | A1 * | 6/2021 | Monferrer | G04B 19/25353 |

FOREIGN PATENT DOCUMENTS

| | | |
|---|---|---|
| CH | 712 165 A2 | 8/2017 |
| EP | 2 784 603 A1 | 10/2014 |

OTHER PUBLICATIONS

European Search Report for EP 20 15 8326 dated Aug. 6, 2020.

* cited by examiner

*Primary Examiner* — Sean Kayes
(74) *Attorney, Agent, or Firm* — Sughrue Mion, PLLC

(57) ABSTRACT

A horological display mechanism including a cam arranged to be driven by a time base, at least a first drive device of a first display of a first quantity, the drive device including a drive rack pivoting about an axis A and being arranged to cooperate, directly or indirectly, with a drive wheel of the first display, the drive rack including a first rigid part having a toothed sector and second elastically deformable part, the first rigid part and second elastically deformable part being separated by a slot receiving an eccentric arranged to cooperate with the elastically deformable part and separate the latter from the first rigid part.

12 Claims, 2 Drawing Sheets

HOROLOGICAL DISPLAY MECHANISM

CROSS-REFERENCE TO RELATED APPLICATIONS

This application claims priority to European Patent Application No. 20158326.7 filed Feb. 19, 2020, the entire contents of which are incorporated herein by reference.

FIELD OF THE INVENTION

The present invention relates to the field of watchmaking or jewellery. It relates more specifically to a horological display mechanism.

BACKGROUND OF THE INVENTION

Traditionally, standard display mechanisms comprise a display hand or a disk and an aperture to display an item of information. The hand or the disk can be riveted directly onto a pinion or a toothed wheel for example.

Once the display is in place, it is then difficult, or even impossible to index it and adjust the position thereof after assembly.

SUMMARY OF THE INVENTION

An aim of the present invention is that of remedying all or some of the drawbacks mentioned above by providing a display mechanism for setting the position of the display independently of the assembly thereof and remaining adjustable after assembly.

The aim of the invention is also that of providing a display mechanism allowing adjustment at all times to compensate for the wear of certain components of the display mechanism.

The aim of the invention is also that of providing a display mechanism having a compact size, of a simple and economical design to manufacture.

For this purpose, the invention relates to a horological display mechanism comprising a cam arranged to be driven by a time base, and at least a first drive means of a first display of a first quantity, said drive means comprising a drive rack pivoting about an axis A and being arranged to cooperate, directly or indirectly, with a drive wheel of said first display, said drive rack comprising a first rigid part comprising a toothed sector and a second elastically deformable part, said first rigid part and second elastically deformable part being separated by a slot receiving an eccentric arranged to cooperate with said elastically deformable part and separate the latter from the first rigid part.

According to further advantageous alternative embodiments of the invention:

- the second elastically deformable part comprises a feeler-spindle arranged to follow the outline of the cam;
- the rigid part comprises a notch opening into the slot, arranged to receive said eccentric;
- said eccentric has a foot of cylindrical shape resting in the notch, a body in the form of an off-centred disk relative to said foot, and a head of cylindrical shape, the body resting on the rigid part and being in point contact with the elastically deformable part;
- the body of the eccentric comprises jags on all or part of the rim thereof and a flat section, the jags being arranged to cooperate with said elastically deformable part;

- the slot has an aperture angle $\alpha$ between 0.08° and 1.04°, the aperture angle $\alpha$ being set by means of the eccentric;
- the cam is a snail cam comprising, on the maximum radius thereof, a beak the passage whereof actuates a jump of the feeler-spindle in return on the minimum radius of the cam;
- said deformable part has a greater thickness than that of the rigid part;
- the display mechanism is retrograde.

The invention also relates to a horological movement comprising at least one display mechanism according to the invention and a watch comprising such a horological movement and/or such a display mechanism.

BRIEF DESCRIPTION OF THE DRAWINGS

Further features and advantages of the present invention will emerge more clearly from the following detailed description of an embodiment example of a horological display mechanism according to the invention, this example being given purely by way of illustration and not merely limitation, with reference to the appended drawing wherein.

DETAILED DESCRIPTION OF PREFERRED EMBODIMENTS

Figure 1:
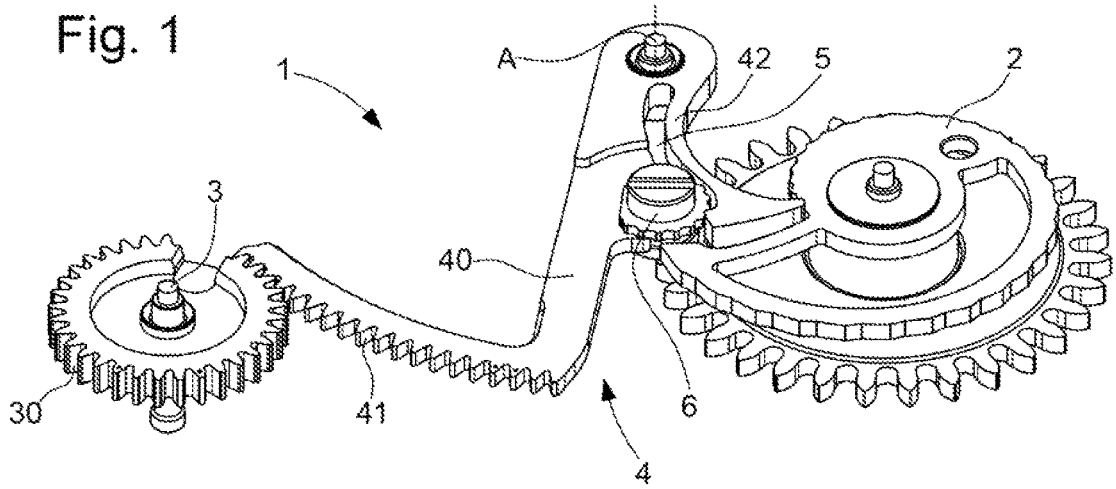
FIG. 1 illustrates a perspective view of a display mechanism according to the invention.
Figure 2A:
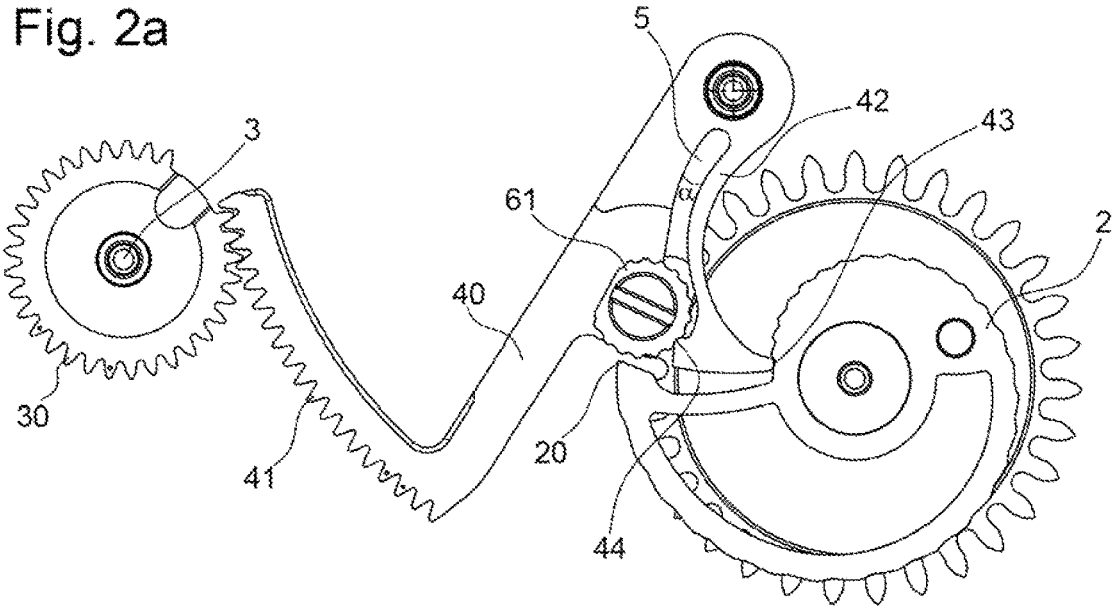
FIGS. 2*a* and 2*b* represent respectively a top view and a bottom view of a display mechanism according to the invention.
Figure 2B:
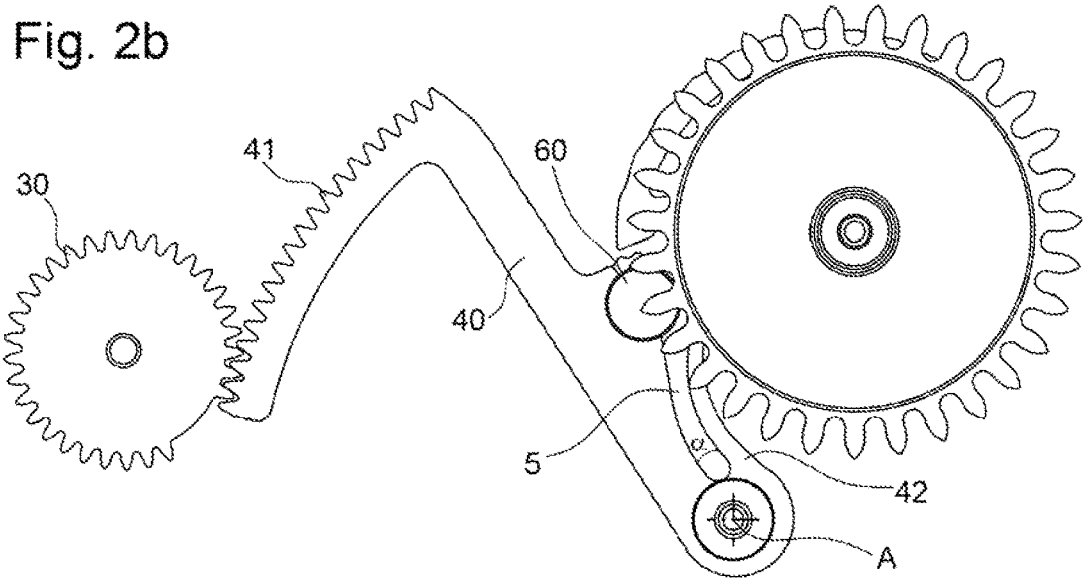

A horological display mechanism will now be described hereinafter with reference jointly to FIGS. 1, 2*a*, 2*b*, 3, 4*a* and 4*b*.

The invention relates to a horological display mechanism 1 comprising a cam 2 arranged to be driven by a time base, at least a first drive means of a first display 3 of a first quantity, the drive means comprising a drive rack 4 pivoting about an axis A and being arranged to cooperate, directly or indirectly, with a drive wheel 30 of the first display 3.

According to the invention, the drive rack 4 comprises a first rigid part 40 comprising a toothed sector 41 and second elastically deformable part 42, said first rigid part 40 and second elastically deformable part 42 being separated, at the level of the pivoting axis A, by a slot 5 receiving an eccentric 6 arranged to cooperate with said elastically deformable part 42 and separate the latter from the first rigid part 40.

The second elastically deformable part 42 comprises at the free end thereof a feeler-spindle 43 arranged to follow the outline of the cam 2 and a heel 44 arranged to cooperate with the eccentric 6, the rack 4 being constrained against the cam 2 by means of a return spring not shown.

Figure 4A:
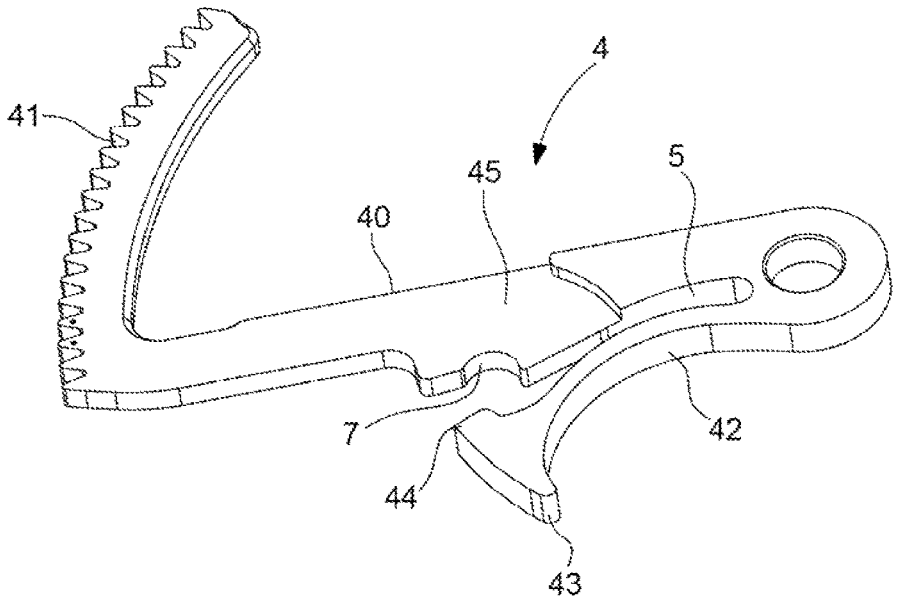
FIGS. 4*a* and 4*b* illustrate respectively a perspective view of a rack and an eccentric of a display mechanism according to the invention.

As can be observed in FIG. 4*a*, the rigid part 40 of the rack 4 comprises a notch 7 opening into the slot 5, the notch 7 being arranged to receive the eccentric 6 and hold it in position.

Figure 4B:
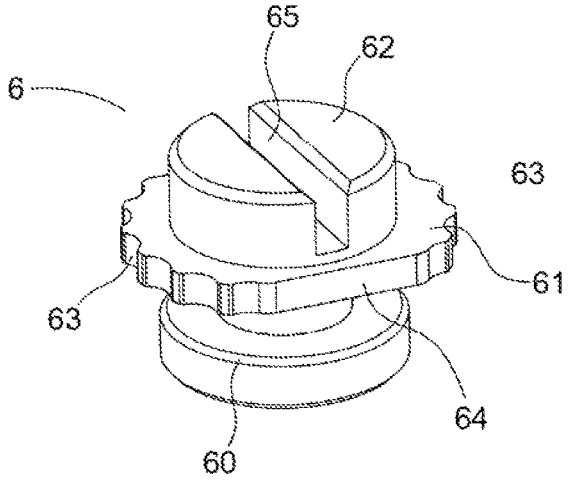

As illustrated in FIG. 4*b*, the eccentric 6 comprises a mushroom-shaped foot 60, a first portion 601 of the foot having a diameter greater than the diameter of the second portion 602. The second portion 602 of the foot of the eccentric is arranged to rest in the notch 7, the first portion resting against the top or bottom face of the rigid part 40 and the eccentric 6. The eccentric 6 comprises a body 61 in the form of an off-centred disk relative to the foot, the body 61 also resting against the top or bottom face of the rigid part 40 of the rack 4, so as to hold the eccentric 6 firmly in place once the latter has been inserted into the notch 7, the first portion 601 and the body 61 each resting against one of the faces of the rigid part 40 of the rack 4.

Advantageously, the eccentric 6 also has a head 62 of cylindrical shape comprising a slot 65 to facilitate rotation and setting using a tool such as a screwdriver for example.

According to an embodiment of the invention, the eccentric is one-piece and forms a single part. Those skilled in the art could envisage producing same in several parts and then assembling them.

As can be observed in FIG. 1, the body 61 rests on the top face of the rigid part 40 and is in point contact with the elastically deformable part 42, near the feeler-spindle 43. The body 61 of the eccentric 6 comprises jags 63 on all or part of the rim thereof and arranged to cooperate with the elastically deformable part, moving from one jag to the next increasing the distance between the centre of the eccentric 6 and the elastic part 42. The body 61 also has a flat section 64 to facilitate the positioning of the eccentric 6 and limit the stress on the elastically deformable part 42, the flat section being placed facing the heel 44 during the insertion of the eccentric 6 in the slot 5 at the level of the notch 7.

The eccentric 6 makes it possible to vary and set the aperture angle $\alpha$ of the slot 5 and implicitly the position of the display 30, the aperture angle $\alpha$ being between 0.08° and 1.04°, a jag (or a step) of the eccentric corresponding to a separation of the elastically deformable part of 0.08°. During the positioning of the eccentric 6 in the slot 5, at the level of the notch 7, the latter exerts a prestress and opens the aperture angle $\alpha$ by 2° relative to the rest position thereof. Such a configuration enables a good hold of the eccentric 6, the latter remaining in the location thereof following a fall of the watch from a height of 50 cm.

In an embodiment of the invention, the cam 2 is a snail cam comprising, on the maximum radius thereof, a beak 20 the passage whereof actuates a jump of the feeler-spindle 43 in return on the minimum radius of the cam. The profile of the cam is adapted to the path to be completed, the above example being dedicated to a retrograde day display. Naturally, other profiles can be achieved according to the needs of those skilled in the art, such as a display of hours, the date, months, years, moon, etc.

As can be observed in the figures, the rigid part 40 of the rack 4 is machined near the eccentric 6 and has a lesser thickness relative to the elastically deformable part 42 so as to facilitate the handling of the eccentric 6. Those skilled in the art would also have been able to position a bore at the level of the eccentric 6, the latter then being surrounded by a rigid part 40.

Figure 3:
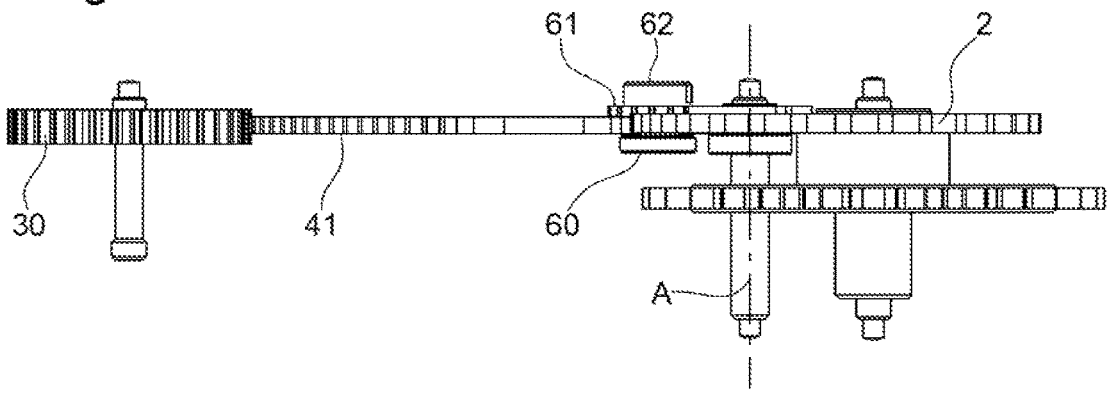
FIG. 3 illustrates a front view of a display mechanism according to the invention.

To position the eccentric 6 in the slot 5 as illustrated in FIGS. 1 to 3, the eccentric 6 is placed near the slot 5 in a first phase by orienting same so that the flat section 64 is in contact with the heel 44 of the elastically deformable part 42. The operator or the user then pushes the eccentric 6 until the eccentric 6 is clipped into the notch 7 using the second portion 602 as guide means, the elastically deformable part 42 exerting a force on the eccentric 6 and holding same in place in the notch 7.

The mechanism is then mounted on a bridge or a plate of a horological movement, and the setting of the first display 3 can be carried out if required. In the case where the operator must modify the display 3, the operator pivots the eccentric 6 via the head 62 by means of a screwdriver, the jags 63 enabling a fine setting and a superior perception for the operator. When the operator pivots the eccentric 6, the body 61 acts upon the elastically deformable part 42 by making it move relative to the axis A and increases the aperture angle $\alpha$ of the slot 5, which has the effect of modifying the position of the drive wheel 30 and ultimately of the display 3.

Once the position has been set, the operator can leave the eccentric 6 in position, the jags 63 and the heel 44 making it possible to hold the eccentric in the position thereof.

In the embodiment described above, the rack and the eccentric are made of a metal or metal alloy but could equally well be made of silicon, ceramic or of composite materials for example.

According to the invention, the display mechanism is a retrograde display.

The invention relates to a horological movement including at least such a display mechanism 1.

The invention further relates to a watch including such a horological movement, and/or including at least such a display mechanism 1.

Thanks to these different aspects of the invention, a readily adjustable and fast display mechanism is provided, independently of the assembly thereof.

Obviously, the present invention is not limited to the example illustrated and is suitable for various variants and modifications which will be obvious to those skilled in the art.

The invention claimed is:

1. An horological display mechanism comprising a cam arranged to be driven by a time base, at least a first drive means of a first display of a first quantity, said drive means comprising a drive rack pivoting about an axis A and being arranged to cooperate, directly or indirectly, with a drive wheel of said first display, said drive rack comprising a first rigid part comprising a toothed sector and second elastically deformable part, said first rigid part and second elastically deformable part being separated by a slot receiving an eccentric arranged to cooperate with said elastically deformable part and separate the latter from the first rigid part.

2. The horological display mechanism according to claim 1, characterised in that the second elastically deformable part comprises a feeler-spindle arranged to follow the outline of the cam.

3. The horological display mechanism according to claim 1, wherein the rigid part comprises a notch opening into the slot, arranged to receive said eccentric.

4. The horological display mechanism according to one of claim 1, wherein said eccentric has successively a foot resting in the notch, a body in the form of an off-centred disk relative to said foot, and a head of cylindrical shape, the body resting on the rigid part and being in point contact with the elastically deformable part.

5. The horological display mechanism according to claim 4, wherein the body of the eccentric comprises jags on all or part of the rim thereof and a flat section, the jags being arranged to cooperate with said elastically deformable part.

6. The horological display mechanism according to claim 1, wherein the slot has an aperture angle $\alpha$ between 0.08° and 1.04°, the aperture angle $\alpha$ being set by means of the eccentric.

7. The horological display mechanism according to claim 6, wherein the cam is a snail cam comprising, on the maximum radius thereof, a beak the passage whereof actuates a jump of the feeler-spindle in return on the minimum radius of the cam.

8. The horological display mechanism according to claim 1, wherein said deformable part has a greater thickness than that of the rigid part.

9. The horological display mechanism according to one of claim 1, characterised in that the display mechanism is retrograde.

10. An horological movement comprising at least one display mechanism according to claim 1.

11. A watch comprising a horological movement according to claim 10.

12. A watch comprising a display mechanism according to claim 1.

* * * * *